US007607659B2

(12) United States Patent
Fukatsu et al.

(10) Patent No.: US 7,607,659 B2
(45) Date of Patent: Oct. 27, 2009

(54) SHEET PROCESSING APPARATUS AND IMAGE FORMING APPARATUS

(75) Inventors: Masayoshi Fukatsu, Sunto-gun (JP); Atsushi Ogata, Mishima (JP); Junichi Sekiyama, Numazu (JP); Hironobu Ata, Susono (JP)

(73) Assignee: Canon Kabushiki Kaisha (JP)

( * ) Notice: Subject to any disclaimer, the term of this patent is extended or adjusted under 35 U.S.C. 154(b) by 251 days.

(21) Appl. No.: 11/261,002

(22) Filed: Oct. 28, 2005

(65) Prior Publication Data

US 2006/0097445 A1 May 11, 2006

(30) Foreign Application Priority Data

Nov. 5, 2004 (JP) ..... 2004-322357

(51) Int. Cl.
*B65H 31/26* (2006.01)

(52) U.S. Cl. ..... 271/220; 270/58.17

(58) Field of Classification Search ..... 270/58.12, 270/58.16, 58.17; 271/220
See application file for complete search history.

(56) References Cited

U.S. PATENT DOCUMENTS 4,458,890 A * 7/1984 Kawazu ..... 271/37
5,026,034 A * 6/1991 Russel et al. ..... 271/220
5,230,503 A 7/1993 Saito et al.
5,931,460 A * 8/1999 Kadowaki et al. ..... 271/220
6,098,975 A * 8/2000 Kobayashi ..... 270/58.09
6,120,020 A * 9/2000 Asao ..... 271/189
6,142,461 A * 11/2000 Asao et al. ..... 270/58.09
6,142,469 A * 11/2000 Nanba et al. ..... 271/288
6,209,864 B1 * 4/2001 Taniguchi et al. ..... 271/220
6,311,971 B1 * 11/2001 Greer et al. ..... 271/220
6,412,774 B1 * 7/2002 Saito et al. ..... 271/220
6,427,997 B1 * 8/2002 Hirota et al. ..... 270/58.12
6,561,503 B1 * 5/2003 Ogata et al. ..... 270/58.12
6,601,840 B2 * 8/2003 Boss et al. ..... 270/58.08
6,601,846 B2 * 8/2003 Saito et al. ..... 271/226
6,634,641 B2 * 10/2003 Yamakawa et al. ..... 271/220
6,666,444 B1 * 12/2003 Paoli ..... 270/58.11
6,726,196 B2 * 4/2004 Kirino ..... 270/58.11

(Continued)

FOREIGN PATENT DOCUMENTS

JP 9-156820 A 6/1997

(Continued)

*Primary Examiner*—Patrick H Mackey
*Assistant Examiner*—Michael C McCullough
(74) *Attorney, Agent, or Firm*—Rossi, Kimms & McDowell, LLP

(57) ABSTRACT

A sheet conveyed to a sheet stacking portion is conveyed in a direction opposite to a sheet conveyance direction by a returning roller to bring a trailing edge of the sheet into abutment against a reference wall and regulate a trailing edge position of the sheet. A pressure portion which presses the sheet to the reference wall is pivotably provided between the returning roller and the reference wall. The pressure portion presses the sheet conveyed by the returning roller to the reference wall while urging the sheet with a first urging force and, after the sheet comes into abutment against the reference wall, is urged by the urging unit to press the sheet, the trailing edge position of which is regulated by the reference wall, with a second urging force larger than the first urging force to hold the sheet.

19 Claims, 8 Drawing Sheets

U.S. PATENT DOCUMENTS 6,739,818 B2 * 5/2004 Aguirre ..... 412/39
6,799,759 B1 * 10/2004 McNamara et al. ..... 270/58.08
6,910,688 B2 * 6/2005 Saito et al. ..... 271/220
6,962,331 B2 * 11/2005 Matsumoto et al. ..... 270/58.09
6,981,697 B2 * 1/2006 Sasa et al. ..... 270/58.11
6,991,225 B2 * 1/2006 Miyake et al. ..... 270/58.09
6,994,339 B2 * 2/2006 Kato et al. ..... 270/58.12
7,172,186 B2 * 2/2007 Saito et al. ..... 270/58.08
7,185,883 B2 * 3/2007 Kato et al. ..... 270/58.11
7,198,261 B2 * 4/2007 Matsumoto et al. ..... 270/58.09
7,207,559 B2 * 4/2007 Mizuta et al. ..... 271/207
7,264,237 B2 * 9/2007 Kato et al. ..... 270/58.12
2003/0062669 A1 4/2003 Yamakawa et al.
2004/0188911 A1 * 9/2004 McNamara et al. ..... 270/58.08
2004/0201165 A1 10/2004 Kamiya et al.
2004/0207142 A1 * 10/2004 Sasa et al. ..... 270/58.08
2006/0017210 A1 * 1/2006 Sato et al. ..... 270/58.08
2006/0071410 A1 * 4/2006 Koie ..... 271/207

FOREIGN PATENT DOCUMENTS

JP 2003-073014 A 3/2003

* cited by examiner

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly to a structure of holding means for holding sheets aligned for processing. The present invention provides a sheet processing apparatus and an image forming apparatus which can stably hold sheets and appropriately align the sheets.

2. Related Background Art

Conventionally, for example, as an image forming apparatus such as a copying machine, a printer, and a facsimile, there is known an image forming apparatus including a sheet processing apparatus which, in order to reduce time and labor required for binding processing and the like for sheets such as copy paper having images formed thereon, sequentially takes the sheets with images formed thereon into the image forming apparatus and selectively applies binding processing, punching processing, and the like to the sheets. As such a sheet processing apparatus, there is known a sheet processing apparatus which temporarily stacks the sheets taken in on an intermediate stacking portion, aligns the sheets, and then performs the binding processing and the like by a stapler to the sheets.

In stacking the sheets on the intermediate stacking portion in this way, an aligned preceding sheet already stacked on the intermediate stacking portion may be pushed out by a subsequent sheet. In this case, alignment of the sheets is not performed appropriately.

Thus, in stacking the sheets on the intermediate stacking portion in this way, in order to prevent the aligned preceding sheet already stacked on the intermediate stacking portion from being pushed out by the subsequent sheet, holding means for holding the preceding sheet after alignment of the preceding sheet is ended is provided.

As such the holding means, for example, there is known a holding means which is arranged outside a sheet conveyance area to prevent the subsequent sheet from colliding with the holding means and holds sheets after sheet conveyance is ended (see Japanese Patent Application Laid-Open No. 2003-73014).

As an image forming apparatus which stacks sheets on an intermediate stacking portion and then switches the sheets back with an intermediate roller to press the sheets against a reference wall for regulating a position of the trailing edges of the sheets, there is known an image forming apparatus which holds sheets using a guide member for guiding the sheets to the reference wall. Note that, when the sheet is held by the guide member in this way, a pressing force of the guide member is weak. Thus, there is known an image forming apparatus which returns a sheet to a reference wall side using belt means formed of a frictional member such as rubber (see Japanese Patent Application Laid-Open No. H09-156820).

However, in such the conventional sheet processing apparatus and image forming apparatus, when the holding means is arranged outside the sheet conveyance area, it is possible to hold a sheet at one end in a width direction of the sheet. Thus, when a push-out force generated by a subsequent sheet is applied to an opposite end of the sheet which is not held, a force for holding the sheets (a holding force) becomes unstable. As a result, a preceding sheet may be pushed out.

When sheets are held by the guide member and returned to the reference wall side by the belt means such that a preceding sheet is not pushed out, if priority is given to a force for returning the sheets (a returning force), a force for gripping the sheets (a gripping force) has to be increased, for example, by increasing a frictional force of a back belt. However, when the gripping force is increased in this way, in aligning the sheets in a width direction thereof, the gripping force of the back belt always in contact with the sheets hinders the alignment. When the gripping force of the back belt is decreased, the holding force becomes unstable. As a result, the preceding sheet may be pushed out.

SUMMARY OF THE INVENTION

The present invention has been made in view of the above circumstances, and it is an object of the present invention to provide a sheet processing apparatus and an image forming apparatus which can stably hold a sheet and appropriately align the sheet.

An object of the present invention is to provide a sheet processing apparatus which processes a sheet, including: a sheet stacking portion which stacks a sheet conveyed thereto; a movement portion which moves the sheet conveyed to the sheet stacking portion; a reference wall which comes into abutment against the sheet moved by the movement portion and regulates the sheet; a pressure portion which is movably provided between the movement portion and the reference wall and presses the sheet moved by the movement portion to the reference wall; and an urging unit which urges the pressure portion in a direction for pressing the sheet which comes into abutment against the reference wall to be regulated in a position, wherein the pressure portion presses the sheet onto a sheet stacking surface of the sheet stacking portion during movement of the sheet by the movement portion to the reference wall, and after the sheet is brought into abutment against the reference wall, the pressure portion is urged by the urging unit to press the sheet onto the sheet stacking surface of the sheet stacking portion with a second urging force larger than the first urging force.

In the present invention, after a sheet is conveyed to the sheet stacking portion, the sheet moved by the movement portion is pressed and is urged by a first urging force by the pressure portion to be brought into abutment against the reference wall, thereby being regulated in position. After the sheet is brought into abutment against the reference wall, the pressure portion is urged by the urging unit to press the sheet, which is regulated in position, with a second urging force larger than the first urging force. Consequently, it is possible to stably hold the sheet and appropriately align the sheet.

DETAILED DESCRIPTION OF THE PREFERRED EMBODIMENTS

Hereinafter, embodiments of the present invention will be explained in detail with reference to the accompanying drawings.

Figure 1:
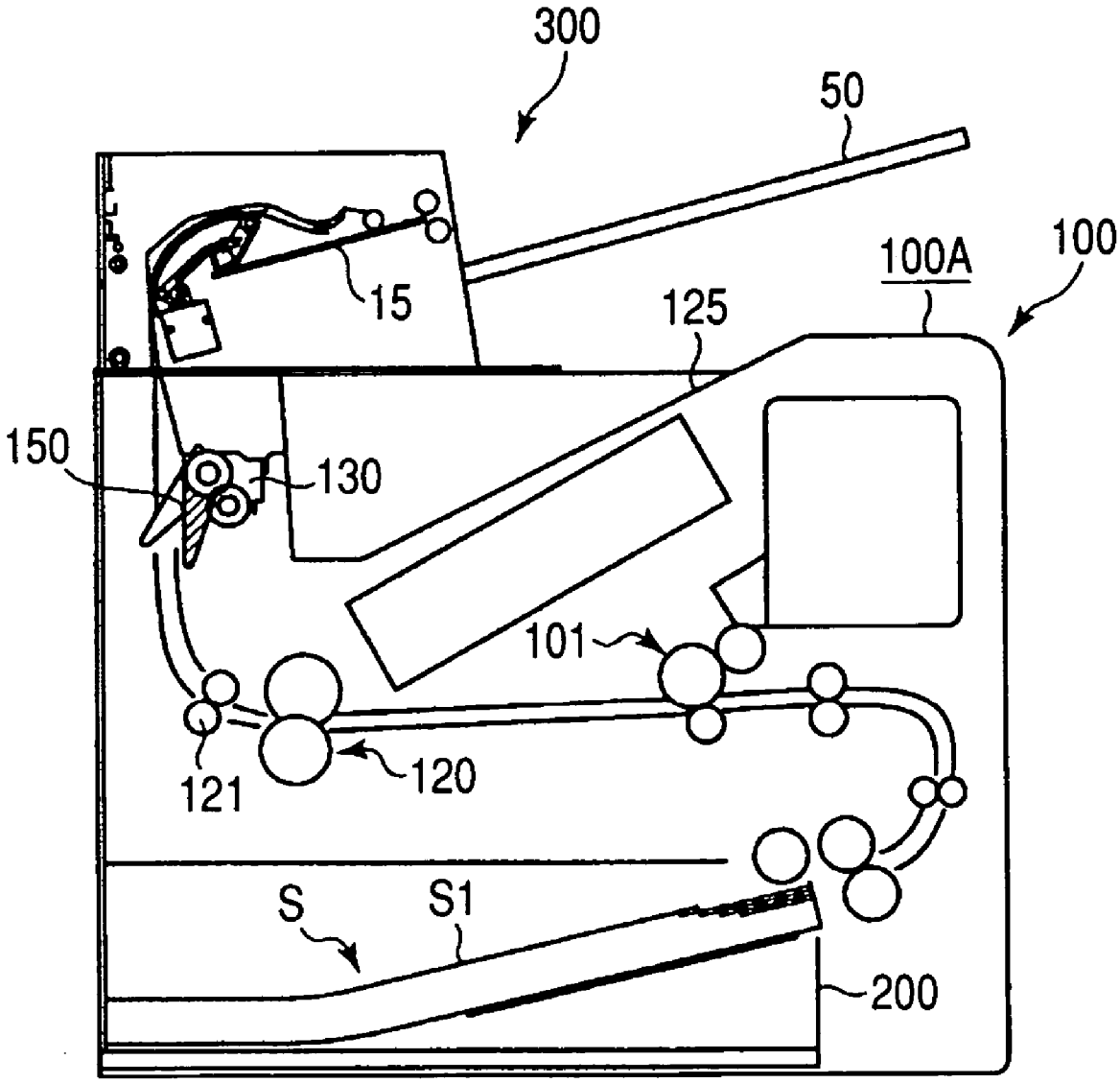
FIG. 1 is a schematic sectional view showing an overall structure of a laser beam printer which is an example of an image forming apparatus provided with a sheet processing apparatus according to a first embodiment of the present invention.

FIG. 1 is a schematic sectional view showing an overall structure of a laser beam printer which is an example of an image forming apparatus including a sheet processing apparatus according to a first embodiment of the present invention.

In FIG. 1, a laser beam printer 100 includes a laser beam printer main body (hereinafter referred to as printer main body) 100A. The laser beam printer 100 is independently connected to a computer or a network such as a Local Area Network (LAN). The laser beam printer 100 forms (prints) an image on a sheet according to a predetermined image formation process on the basis of image information, a print signal, or the like sent from the computer or the network and discharges the sheet.

A sheet processing apparatus 300 is arranged above the printer main body 100A. After sequentially taking sheets, which are discharged to the outside of the laser beam printer 100 from the printer main body 100A, into the sheet processing apparatus 300, the sheet processing apparatus 300 places the sheets on an intermediate tray 15 serving as a sheet stacking portion. Thereafter, the sheet processing apparatus 300 aligns the sheets, bundles the sheets for each predetermined job, and staples one or plural parts of the sheets. Note that the sheet processing apparatus 300 can also simply discharge and stack the sheets on a sheet discharge tray 50.

Structures of respective portions of the printer main body 100A will be explained in an order of arrangement of the portions along a conveyance path of a sheet S to be conveyed.

In the printer main body 100A, plural sheets S are stacked in a sheet feeding cassette 200. The sheets S are sequentially separated and are fed one by one in order from an uppermost sheet S1 by various rollers. In response to a predetermined print signal supplied from the computer or the network, a toner image is first transferred onto an upper surface of the sheet S fed from the sheet feeding cassette 200 in an image forming portion 101 which forms the toner image according to an image formation process of a so-called laser beam system. Subsequently, heat and pressure are applied to the sheet S in a fixing device 120 on a downstream side, whereby the toner image is permanently fixed on the sheet S.

The sheet S having the toner image fixed thereon is turned back in a substantially U-shaped sheet conveyance path leading to a discharge roller 130. Consequently, an imaging surface is reversed. The sheet S is discharged to the outside from the printer main body 100A in a face-down state in which the imaging surface faces downward.

The sheet S is selectively discharged to, for example, a face-down (FD) discharge portion 125 provided in the upper portion of the printer main body 100A by the discharge roller 130 or discharged to an intermediate tray 15 of the sheet processing apparatus 300 according to a position of a flapper 150 of the printer main body 100A which turns on the basis of a control signal from a control portion (not shown) provided in the printer main body 100A.

Next, a structure of the sheet processing apparatus 300 will be explained.

Figure 2:
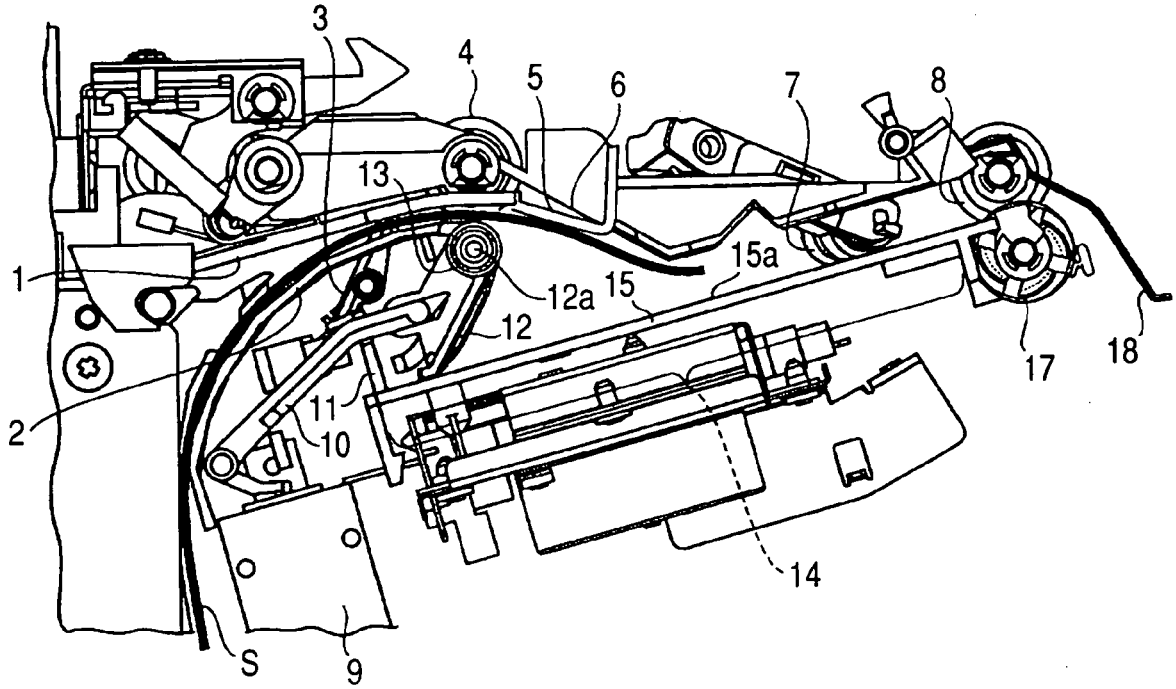
FIG. 2 is an enlarged view showing a structure of the sheet processing apparatus.

FIG. 2 is an enlarged view of the sheet processing apparatus 300. In FIG. 2, the sheet S discharged from the printer main body 100A is conveyed to the intermediate tray 15 by an upper intermediate roller 4 and a lower intermediate roller 13 while being guided by an upper entrance guide 1 and a lower entrance guide 2. Note that a portion indicated by a dotted line in FIG. 2 is an intermediate stacking portion 14 for performing processing such as stapling described later.

In this way, the sheet is conveyed to the intermediate tray 15 by the pair of intermediate rollers 4 and 13 which are provided above the intermediate tray 15 and serve as discharge rollers for discharging the sheet S to the intermediate tray 15. The sheet S is guided to an upper discharge roller 8 and a lower discharge roller 17 by a conveyor guide 6 and is then conveyed by the pair of discharge rollers 8 and 17. When a trailing edge of the sheet S passes the pair of intermediate rollers 4 and 13, the trailing edge is pressed downward by a paper dropping flag 5. Consequently, the sheet S falls to the intermediate tray 15.

The sheet S fallen on the intermediate tray 15 is conveyed in a direction opposite to the sheet conveyance direction by a returning roller 7 serving as a movement portion. Consequently, the trailing edge of the sheet S is brought into abutment against an alignment reference wall 11 serving as a reference wall for aligning sheets in the sheet conveyance direction. Note that the pair of discharge rollers 8 and 17 are made separable. When the sheet S is conveyed reversely, the pair of discharge rollers 8 and 17 are in a separated state.

Figure 3:
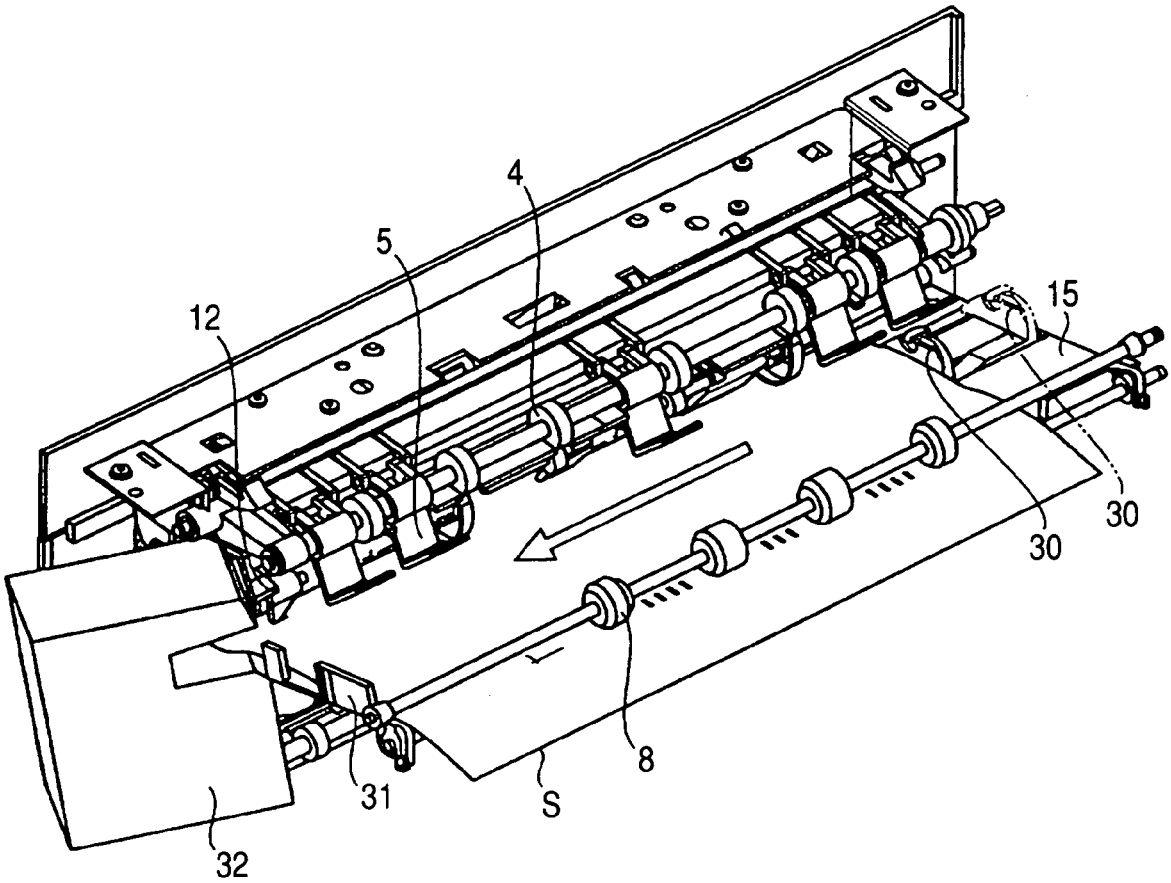
FIG. 3 is a perspective view of a substantial part of the sheet processing apparatus.

After the sheet S is aligned in the sheet conveyance direction as described above, width direction aligning means 30 shown in FIG. 3, which aligns a position of the sheet S in a width direction orthogonal to the sheet conveyance direction thereof, moves in a direction indicated by the arrow from a standby position indicated by an imaginary line until the sheet S collides with a width direction reference wall 31. The width direction aligning means 30 thus performs an alignment operation in the width direction for the sheet S.

After stacking a predetermined number of sheets S on the intermediate tray 15 by repeating the alignment operation for the sheets in the sheet conveyance direction and in the width direction of the sheets, the sheet processing apparatus 300 applies binding processing to a sheet end with a stapler 32. Note that, after the binding processing is performed in this way, a sheet bundle is discharged to a discharge tray 50 shown in FIG. 1 by the pair of sheet discharge rollers 8 and 17. Referring to FIG. 2, the control portion detects a full load of the sheets S on the discharge tray 50 with a full load detection flag 18. Note that, in this embodiment, the control portion of the printer main body 100A directly controls the sheet processing apparatus 300. However, a finisher control portion may be provided on the sheet processing apparatus 300 side to control the sheet processing apparatus 300 via the finisher control portion. This makes it unnecessary to give the printer main body 100A a control function which is based on a premise that the sheet processing apparatus 300 is mounted as an option. Only a control portion having requisite minimum functions has to be provided.

As shown in FIG. 2, an upper guide 12 serving as holding means (a pressure portion), which guides a leading edge of the sheet S conveyed toward the alignment reference wall 11, is provided between the alignment reference wall 11 and the returning roller 7. The trailing edge of the sheet S returned by the returning roller 7 is guided to and is brought into abutment against the alignment reference wall 11 by the upper guide 12.

Figure 4:
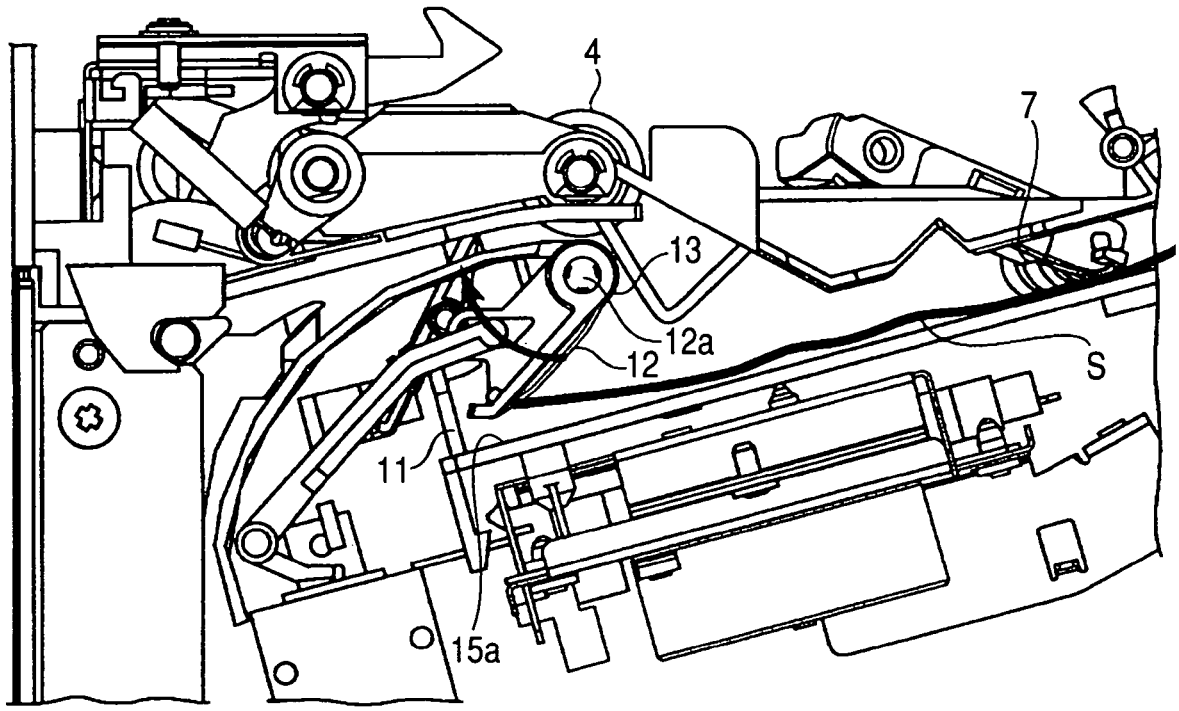
FIG. 4 is a diagram showing a state in which a sheet is guided by an upper guide of the sheet processing apparatus.

The upper guide 12 is pivotably held by a fulcrum 12*a*. The upper guide 12 comes into contact with a sheet stacking surface 15*a* of the intermediate tray 15 further on the alignment reference wall side than the fulcrum 12*a*. This makes it possible to guide the sheet S smoothly while urging the sheet S with a first urging force. Usually, the upper guide 12 is in a position where a distal end of the upper guide 12 is in contact with the sheet stacking surface 15*a* of the intermediate tray 15 because of the own weight of the upper guide 12 (the first urging force). When the sheet S returned comes into abutment against the upper guide 12, the upper guide 12 guides the sheet S to the alignment reference wall 11 while being pushed by the sheet S to turn upward as indicated by an arrow of FIG. 4.

Note that, in order to surely bring the sheet S into abutment against the alignment reference wall 11, the returning roller 7 is controlled to return the sheet S by an amount more than necessary. In this case, the upper guide 12 also functions to suppress generation of a loop which is caused because the sheet S is returned by an amount more than necessary. In this embodiment, the first urging force is set such that the upper guide 12 comes into contact with the intermediate tray 15 because of the own weight thereof. However, an urging member such as a spring may be further provided to adjust the first urging force at the time of sheet guide depending on rigidity or the like of the sheet S such that the upper guide 12 can surely suppress generation of the loop.

Such a first urging force at the time of sheet guide is set in a range in which the upper guide 12 presses the loop caused in the sheet S while being pushed by the sheet S to turn upward. When the first urging force with which the upper guide 12 cannot be pushed by the sheet S to turn upward is set, it is likely that occurrence of jam, damage to the sheet S, or the like is caused.

After the trailing edge of the sheet S collides with the alignment reference wall 11, the upper guide 12 holds the sheet S with the own weight (the first urging force). When the sheet S is curled, it is possible to reduce the curl of the sheet S by holding the sheet S in this way.

Figure 5:
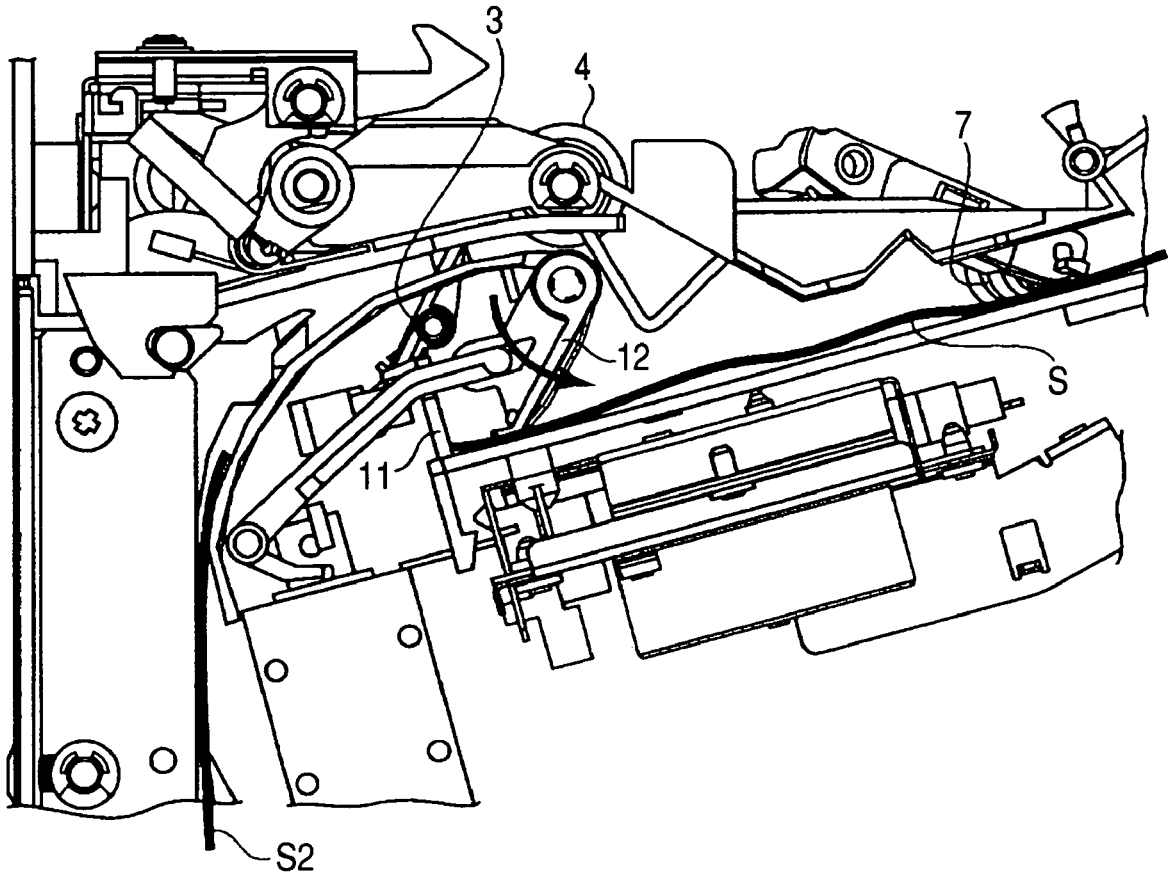
FIG. 5 is a diagram showing a state in which a sheet is held by the upper guide.

As shown in FIG. 2, a link lever 10 is actuated by a solenoid 9 serving as an actuator constituting the urging unit for urging the upper guide 12 together with the link lever 10 in a direction for pressing the sheet S, a trailing edge position of which is regulated by the alignment reference wall 11, to cause the upper guide 12 to rotate downward. When the link lever 10 causes the upper guide 12 to rotate downward, the upper guide 12 usually in the position in which the distal end thereof is in contact with the intermediate tray 15 because of the own weight (the first urging force) moves to a position where the upper guide 12 presses the sheet S onto the sheet stacking surface 15*a* of the intermediate tray 15 as indicated by an arrow of FIG. 5.

Since the upper guide 12 moves to the position where the upper guide 12 presses the sheet S onto the sheet stacking surface 15*a* of the intermediate tray 15, the upper guide 12 can press the sheet S onto the intermediate tray 15 with a second urging force larger than the own weight (the first urging force).

The upper guide 12 is usually in the position where the distal end thereof is in contact with the intermediate tray 15 because of the own weight (the first urging force). When the solenoid 9 is actuated, the upper guide 12 can press the sheet S onto the intermediate tray 15 with the second urging force larger than the first urging force due to the own weight, via the link lever 10. Since the sheet S is pressed by the upper guide 12, when the subsequent sheet S2 is stacked on the intermediate tray 15 after this, it is also possible to prevent the preceding sheet S from being pushed out by the subsequent sheet S2.

As shown in FIG. 2, a sensor 3 for detecting the sheet S is provided upstream with respect to the pair of intermediate rollers 4 and 13. Timing for pressing the sheet S onto the sheet stacking surface 15*a* of the intermediate tray 15 by applying an urging force to the upper guide 12, that is, retraction timing of the solenoid 9 is controlled in response to a detection signal from the sensor 3 such that an retracting operation of the solenoid 9 ends before the leading edge of the subsequent sheet S2 reaches the pair of intermediate rollers 4 and 13. This makes it possible to prevent the preceding sheet S from being pushed out by the subsequent sheet S2.

Note that timing for releasing the application of the urging force to the upper guide 12, that is, timing for stopping retraction of the solenoid 9 is set to be after a trailing edge of the subsequent sheet S2 passes the pair of intermediate rollers 4 and 13. Since the application of the urging force is released at such timing, the upper guide 12 can surely guide the sheet S, which is returned by the returning roller 7, to the alignment reference wall 11.

Figure 6:
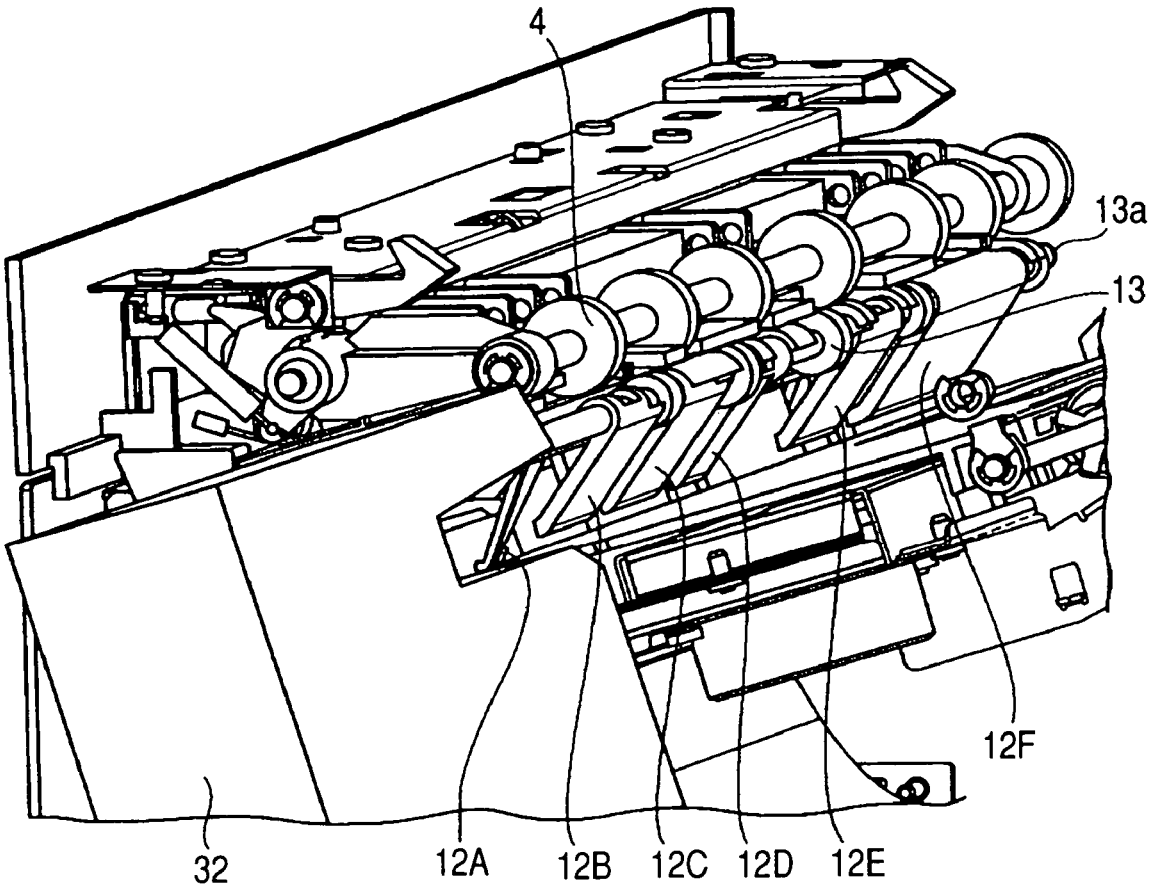
FIG. 6 is a perspective view showing a structure of the upper guide.

In this embodiment, the fulcrum 12*a* (see FIG. 2) of the upper guide 12 is used as a shaft 13*a* of the lower intermediate roller 13 shown in FIG. 6. Since the fulcrum 12*a* of the upper guide 12, which is pivotable, is used as the shaft 13*a* of the lower intermediate roller 13, it is possible to eliminate a joint of a guide between the returning roller 7 and the alignment reference wall 11 and prevent the sheet S moving to the alignment reference wall 11 from getting hung up.

In this embodiment, plural upper guides 12 are provided in the width direction as shown in FIG. 6. The upper guides 12 are axially supported on the lower intermediate roller 13 independently from one another to be pivotable with their own weight. Since the plural upper guides 12A to 12F are provided in the width direction in this way, it is possible to stably hold at least both ends of the trailing edge of the sheet S in the width direction.

In this embodiment, only the upper guide 12A at the end among the upper guides 12A to 12F is linked with the solenoid 9 and generates an urging force with the solenoid 9. Note that, if some or all of the upper guides 12A to 12F are linked with the solenoid 9 to perform an operation for holding the sheet S, the sheet S is held more stably.

In this way, the sheet S conveyed to the intermediate tray 15 is guided and is brought into abutment against the alignment reference wall 11 while being urged with the first urging force by the upper guide 12 to regulate a trailing edge position of the sheet S. After the sheet S is brought into abutment against the alignment reference wall 11, the upper guide 12 is urged by the urging unit constituted by the solenoid 9 and the link lever 10 to press the sheet S, the trailing edge position of which is regulated, with the second urging force larger than the first urging force. This makes it possible to stably hold the sheet S while realizing satisfactory sheet guide and appropriately align the sheet S. Moreover, since the upper guide 12 serving as the pressure portion is used as holding means for holding the sheet S, it is possible to reduce cost.

Note that, in this embodiment, the guide structure for guiding a sheet in the direction opposite to the sheet conveyance direction with the returning roller 7 is described. However, the same guide structure may be provided in a direction orthogonal to the sheet conveyance direction. Moreover, the movement portion may be a returning belt or a paddle. In the guide structure in the direction orthogonal to the sheet conveyance direction, the movement portion may be a jogger serving as aligning means which conveys a sheet conveyed to the sheet stacking portion in the direction orthogonal to the sheet conveyance direction and brings the sheet into abutment against a reference wall for regulating side ends of the sheet to align the sheet.

A second embodiment of the present invention will be explained.

Figure 7:
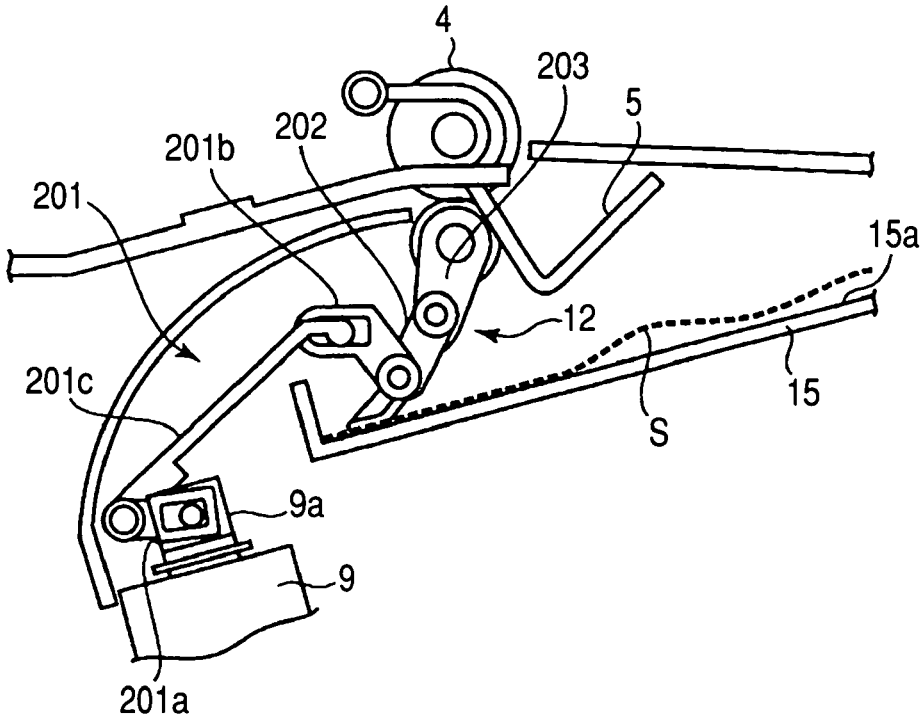
FIG. 7 is an enlarged view of a substantial part of a sheet processing apparatus according to a second embodiment of the present invention.

FIG. 7 is an enlarged view of a substantial part of the sheet processing apparatus 300 according to this embodiment. Note that, in FIG. 7, reference numerals and symbols identical with those of FIG. 2 denote portions identical with or equivalent to those of FIG. 2.

In FIG. 7, reference numeral 202 denotes a tip lever and 203 denotes a root lever which pivotably holds the tip lever 202. The upper guide 12 is constituted by the root lever 203 and the tip lever 202. Note that a bottom surface at a distal end portion of the tip lever 202 is planar such that the upper guide 12 can hold sheet S on a plane.

Reference numeral 201 denotes a solenoid link which transmits an operation of the solenoid 9 to the upper guide 12. The solenoid link 201 is constituted by a first lever 201*a*, one end of which is pivotably attached to a plunger 9*a* of the solenoid 9, a second lever 201*b*, one end of which is pivotably attached to the distal end portion of the tip lever 202, and a third lever 201*c*, one end of which is pivotably held at a pivotal end of the first lever 201*a* and the other end of which is slidably held at a pivotal end of the second lever 201*b*.

Figure 8:
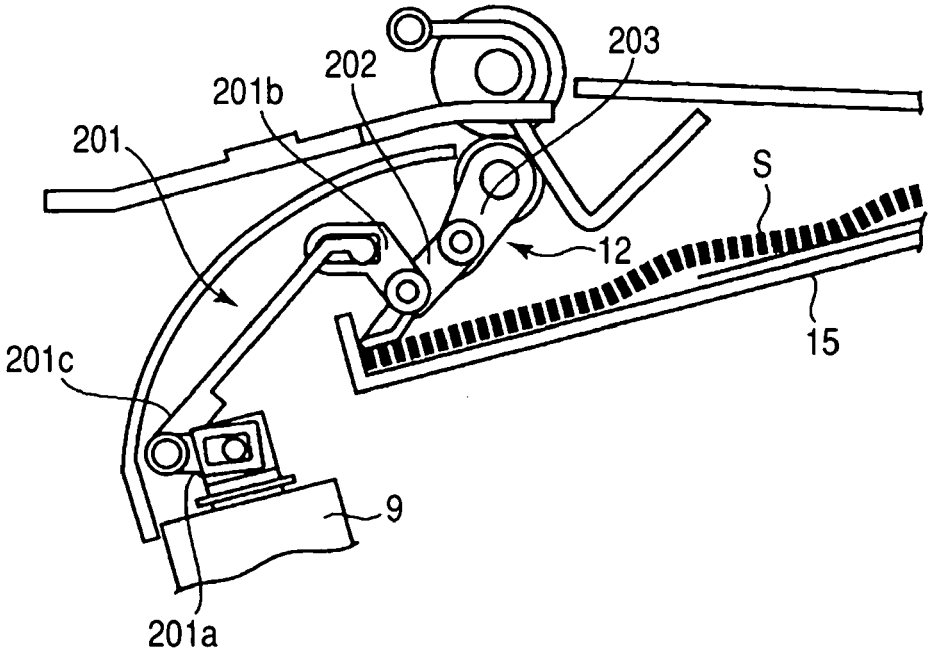
FIG. 8 is a diagram showing a state in which a sheet is held by the upper guide.

The upper guide 12 is driven by the solenoid link 201 having such a structure. The upper guide 12 is constituted by the plural levers including the root lever 203 and the tip lever 202. Consequently, when one sheet S is held as shown in FIG. 7 and when plural sheets S are held as shown in FIG. 8, it is possible to bring the upper guide 12 into surface contact with the sheet S.

In this way, the upper guide 12 is constituted by the root lever 203 and the tip lever 202 and the distal end portion of the tip lever 202 for pressing the sheet S is made rotatable. Consequently, even if the number of stacked sheets changes and an upper surface position of the sheet S changes, it is possible to always hold the sheet S on a plane in the same manner and reduce fluctuation in a holding force.

Next, a third embodiment of the present invention will be explained.

Figure 9:
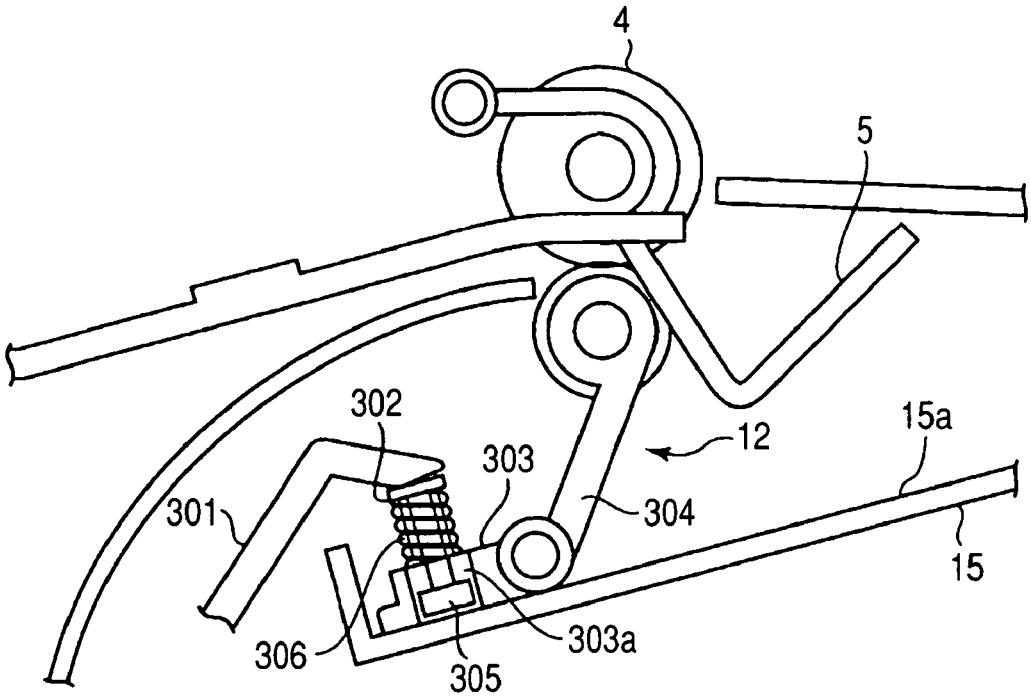
FIG. 9 is an enlarged view of a substantial part of a sheet processing apparatus according to a third embodiment of the present invention.
Figure 10:
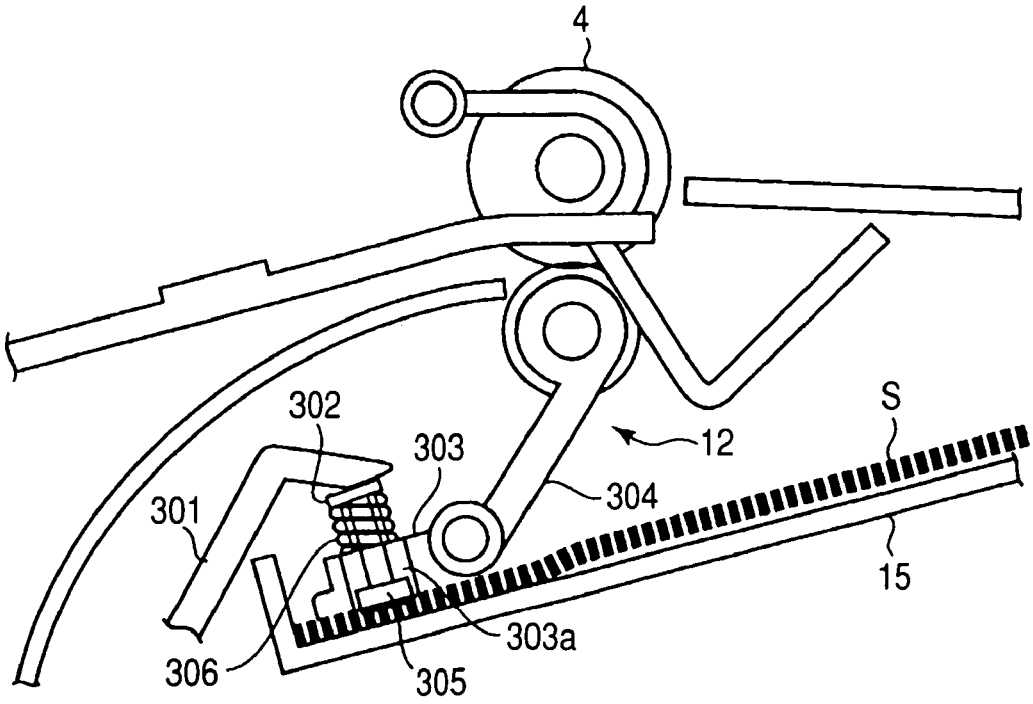
FIG. 10 is a diagram showing a state in which a sheet is held by the upper guide.

FIG. 9 is an enlarged view of a substantial part of the sheet processing apparatus 300 according to this embodiment. Note that, in FIG. 9, reference numerals and symbols identical with those of FIG. 2 denote portions identical with or equivalent to those of FIG. 2.

In FIG. 9, reference numeral 303 denotes a tip lever and 304 denotes a root lever which pivotably holds the tip lever 303. The upper guide 12 is constituted by the root lever 304 and the tip lever 303. Note that a distal end portion of the tip lever 303 is planar such that the upper guide 12 can hold the sheet S on a plane.

Reference numeral 302 denotes a pressure member which is provided in a hole 303*a*, which is formed at the planar distal end portion of the tip lever 303, to be capable of moving vertically. Usually, the pressure member 302 is lifted by a spring 306. However, when the solenoid 9 is actuated, the pressure member 302 is pressed by the link lever 301 to move downward while resisting the spring 306.

A frictional member 305 formed of, for example, rubber is provided at a lower end of the pressure member 302 pressing the sheet S. When the tip lever 303 moves downward, the frictional member 305 retracted in the hole 303*a* as shown in FIG. 9 projects from a lower surface of the tip lever 303 to hold a surface of the sheet S. Note that, in this structure, the tip lever 303 is also urged downward via the pressure member 302 and the spring 306.

The pressure member 302 including the frictional member 305 at the lower end thereof is provided at the distal end portion of the tip lever 303. The pressure member 302 is urged and pushed down by an urging unit constituted by the solenoid 9 and the link lever 301 to hold the sheet S. The tip lever 302 is also urged downward via the pressure member 302 and the spring 306. Consequently, it is possible to increase a force against a push-out force of a subsequent sheet.

In the above explanation, the solenoid is used as the actuator constituting the urging unit for urging the upper guide 12. However, a motor or the like may be used as the actuator.

This application claims priority from Japanese Patent Application No. 2004-322357 filed on Nov. 5, 2004, which is hereby incorporated by reference herein.

What is claimed is:

1. A sheet processing apparatus which processes a sheet, comprising:

a sheet conveying portion which conveys the sheet;

a sheet stacking portion which stacks the sheet conveyed by the sheet conveying portion thereto;

a movement portion which moves the sheet conveyed to the sheet stacking portion;

a reference wall against which the sheet moved by the movement portion abuts, the reference wall regulating the sheet;

a pressure portion which is movably provided between the movement portion and the reference wall, the pressure portion pressing the sheet with a first urging force while the movement portion is moving the sheet to the reference wall; and an urging unit which urges the pressure portion in a direction for pressing the sheet, a controller configured to control the urging unit to urge the pressure portion to hold the sheet regulated by the reference wall with a second urging force larger than the first urging force while a subsequent sheet is passing through the sheet conveying portion.

2. A sheet processing apparatus according to claim 1, wherein the reference wall regulates a trailing edge of the sheet, and the movement portion conveys the sheet conveyed to the sheet stacking portion in a direction opposite to a sheet conveyance direction and brings the sheet into abutment against the reference wall.

3. A sheet processing apparatus according to claim 1, wherein the sheet conveying portion comprises a discharge roller which is provided above the sheet stacking portion and discharges the sheet to the sheet stacking portion, wherein the pressure portion is pivotably attached to a shaft of the discharge roller.

4. A sheet processing apparatus according to claim 3, wherein the controller is configured to control the urging unit to release a pressure exerted to a preceding sheet by the second urging force after a trailing edge of the subsequent sheet passes the discharge roller.

5. A sheet processing apparatus according to claim 1, wherein the pressure portion includes a plurality of pressure members that are provided in a direction orthogonal to a sheet conveyance direction and are pivotable independently from one another.

6. A sheet processing apparatus according to claim 5, wherein the urging unit urges at least one of the pressure members.

7. A sheet processing apparatus according to claim 1, wherein the first urging force of the pressure portion is at least one of a gravitational force caused by an own weight of the pressure portion or a force generated by a spring.

8. A sheet processing apparatus according to claim 1, wherein the reference wall regulates side ends of the sheet, and the movement portion conveys the sheet conveyed to the sheet stacking portion in a direction orthogonal to a sheet conveyance direction and brings the sheet into abutment against the reference wall.

9. A sheet processing apparatus according to claim 1, wherein the pressure portion is pivotal so that a distal end portion thereof presses the sheet.

10. A sheet processing apparatus according to claim 9, further comprising a pressure member formed of a high friction material and provided at the distal end portion retractably, wherein after the sheet is brought into abutment against the reference wall, the pressure member is urged by the urging unit to press the sheet.

11. A sheet processing apparatus according to claim 10, further comprising a frictional member provided in a portion of the pressure member pressing the sheet.

12. An image forming apparatus which forms an image on a sheet, comprising:

an image forming portion; and a sheet processing apparatus which processes a sheet on which an image is formed by the image forming portion, the sheet processing apparatus including:

a sheet conveying portion which conveys the sheet;

a sheet stacking portion which stacks the sheet conveyed by the sheet conveying portion thereto;

a movement portion which moves the sheet conveyed to the sheet stacking portion;

a reference wall against which the sheet moved by the movement portion abuts, the reference wall regulating the sheet;

a pressure portion which is movably provided between the movement portion and the reference wall, the pressure portion pressing the sheet with a first urging force while the movement portion is moving the sheet to the reference wall;

an urging unit which urges the pressure portion in a direction for pressing the sheet; and a controller configured to control the urging unit to urge the pressure portion to hold the sheet regulated by the reference wall with a second urging force larger than the first urging force while a subsequent sheet is passing through the sheet conveying portion.

13. An image forming apparatus according to claim 12, wherein the reference wall regulates a trailing edge of the sheet, and the movement portion conveys the sheet conveyed to the sheet stacking portion in a direction opposite to a sheet conveyance direction and brings the sheet into abutment against the reference wall.

14. An image forming apparatus according to claim 12, wherein the sheet conveying portion comprises a discharge roller which is provided above the sheet stacking portion and discharges the sheet to the sheet stacking portion, wherein the pressure portion is pivotably attached to a shaft of the discharge roller.

15. An image forming apparatus according to claim 14, wherein the controller is configured to control the urging unit to releas a pressure exerted to a preceding sheet by the second urging force after a trailing edge of the subsequent sheet passes the discharge roller.

16. An image forming apparatus according to claim 12, wherein the pressure portion includes a plurality of pressure members that are provided in a direction orthogonal to a sheet conveyance direction and are pivotable independently from one another.

17. An image forming apparatus according to claim 16, wherein the urging unit urges at least one of the pressure members.

18. An image forming apparatus according to claim 12, wherein the first urging force of the pressure portion is at least one of a gravitational force caused by an own weight of the pressure portion or a force generated by a spring.

19. An image forming apparatus according to claim 12, wherein the reference wall regulates side ends of the sheet, and the movement portion conveys the sheet conveyed to the sheet stacking portion in a direction orthogonal to a sheet conveyance direction and brings the sheet into abutment against the reference wall.

* * * * *